US005964278A

United States Patent [19]

Langoy et al.

[11] Patent Number: 5,964,278

[45] Date of Patent: Oct. 12, 1999

[54] HEAT EXCHANGER

[75] Inventors: Jostein Langoy, Spikkkestad; Nils Myklebust, Trondheim; Nils I. Viken, deceased, late of Hamar; Steiner Lynum, Oslo; Alfhild Irene Fagervik, Ottestad, all of Norway, legal representative of Nils Viken, deceased

[73] Assignee: Kvaerner Engineering a.s, Lysaker, Norway

[21] Appl. No.: 08/737,294

[22] PCT Filed: May 5, 1995

[86] PCT No.: PCT/NO95/00075

§ 371 Date: Feb. 4, 1997

§ 102(e) Date: Feb. 4, 1997

[87] PCT Pub. No.: WO95/30870

PCT Pub. Date: Nov. 16, 1995

[30] Foreign Application Priority Data

May 9, 1994 [NO] Norway ..... 941727

[51] Int. Cl.[6] ..... F28F 5/06

[52] U.S. Cl. ..... 165/87; 165/86; 165/92; 165/94; 165/95

[58] Field of Search ..... 165/95, 94, 92, 165/87, 86, 88

[56] References Cited

U.S. PATENT DOCUMENTS

| | | | |
|---|---|---|---|
| 3,548,926 | 12/1970 | Archer | 165/92 |
| 3,923,097 | 12/1975 | Hovad | 165/92 |
| 4,558,733 | 12/1985 | Lindroos | 165/94 |
| 5,462,429 | 10/1995 | Pritchard et al. | 165/94 X |

FOREIGN PATENT DOCUMENTS

| | | | |
|---|---|---|---|
| 0271459 | 6/1988 | European Pat. Off. | 165/94 |
| 1070657 | 12/1959 | Germany | 165/87 |
| 277203 | 5/1969 | U.S.S.R. | 165/94 |
| 0647516 | 2/1979 | U.S.S.R. | 165/94 |
| 0787054 | 12/1980 | U.S.S.R. | 165/94 |
| 0840666 | 6/1981 | U.S.S.R. | 165/94 |
| 1250828 | 8/1986 | U.S.S.R. | 165/94 |
| 1246692 | 4/1991 | U.S.S.R. | 165/94 |
| 739288 | 10/1955 | United Kingdom | 165/94 |

*Primary Examiner*—Ira S. Lazarus
*Assistant Examiner*—Christopher Atkinson
*Attorney, Agent, or Firm*—W. Warren Taltavull; Farkas & Manelli PLLC

[57] ABSTRACT

A heat exchanger has been developed with a helical insert (9) permanently mounted in a housing (2). Between the windings in the insert (9) there is formed a helical channel (20) for one heat exchange medium. The insert (9) is designed with a channel (10) for the second heat exchange medium. The heat exchanger is designed with a central tube (13) which is axially movable and rotatable. The central tube (13) is designed with scraper elements for removal of deposits in the channel (20). In one embodiment the scraper element is formed by a helical insert (15) of the same design as the insert (9). The insert (15) is designed with a channel (16) for the second heat exchange medium. In a further embodiment the central tube (13) is designed with one or more scraper arms (23) which may be liquid-cooled. Deposits are often formed on the heat transfer surfaces. A cleaning cycle is performed by means of axial movement of the insert (15) which is mounted on the central tube (13) towards the permanently mounted insert (9), thus causing the heat transfer surfaces to touch each other. A rotating movement is then performed, e.g., a part of a turn, while the surfaces are close to each other or in contact with each other, thus causing the deposits on the two surfaces to be rubbed or scraped off and thereby cleaning the channel (20).

7 Claims, 3 Drawing Sheets

HEAT EXCHANGER

This application is the national phase of international application PCT/No. 95/00075 filed May 5, 1995 which designated the U.S.

FIELD OF THE INVENTION

The present invention concerns a heat exchanger designed as a housing with one or more helical inserts with a through-flowing heating or cooling medium, and devices for keeping the heat transfer surfaces clean during operation.

BACKGROUND OF THE INVENTION

The heat exchanger should maintain a good heat transfer performance when a medium flows through it which has a strong tendency to deposit a coating on the channel walls. In the following description this medium is called "the primary medium" or "the process medium". The primary medium may be a product flow from a process in the form of a gas with solid particles, flue gas with soot, or a liquid. On the other side of the heat transfer walls flows a second medium, called "the secondary medium" or "the service medium", whose task is either to cool or heat up the primary medium. The secondary medium may be a gas or a liquid.

The helical insert has internal channels through which the secondary medium flows. The cross section of the insert may be in the form of one or more rectangular tubes adjacent to one another or several round tubes adjacent to one another, and for the sake of simplicity is called "tube spool" in the following description.

At one end of the cylindrical housing there is an intake for the primary medium, which flows through the windings in the insert or inserts to the outlet at the other end. The secondary medium can be parallel flow or counterflow according to what is most suitable for the process.

The invention comprises a heat exchanger which is equipped with a central tube which extends along the centre axis of the housing. The central tube is both axially movable and rotatable. On the central tube there is mounted a device for removal of deposits on the walls of the channel in which the primary medium is conveyed.

On the heat transfer surfaces of a heat exchanger particles will often be precipitated which will adhere to the surfaces and be deposited as a coating which will reduce the heat transfer. The performance of the heat exchanger is highly dependent on its having clean surfaces. It has been shown that even a thin layer of particles or a thin coating of deposits will substantially reduce the performance. If a thicker layer of coating is formed it will also narrow the channel opening, thus increasing the flow resistance and thereby obstructing the through-flow of the medium.

The temperature of the primary medium is sometimes so high that the coating hardens after a short time and it thus becomes necessary to keep the cooling surfaces clean in an efficient manner without the addition of foreign matter which will pollute the product flow.

A common problem with heat exchangers is that it is a relatively complicated process to remove fouling. Many different designs of cleaning equipment are known and many methods for internal and external removal of fouling on tubes, plates, shell and housing.

The usual method of cleaning heat exchangers is to wash both the tubes and the housing with a liquid to which may be added a solvent for the fouling concerned. Another method which is used is to dismantle the entire heat exchanger and clean the whole tube bundle and housing mechanically by means of washing and brushing. However, both of these methods require the heat exchanger to be disconnected from the process, which is normally both a costly and laborious procedure.

In WO 88/01362 there is disclosed a heat exchanger with a plurality of helical tube spools wherein the tube spools are composed of a plurality of parallel tubes located beside one another. The tube spools with a distributing head at each end are mounted on to a longitudinal central tube, thus enabling the entire tube bundle with the distributing heads to be withdrawn from the housing. The dismantling process is thereby facilitated, thus reducing the cleaning time. However, the heat exchanger is not designed to be self-cleaning or with cleaning equipment.

In NO 45071 there is disclosed a rotating heat exchanger with permanently installed scraper devices. The scraper devices are located in the channels in which the flue gas is conveyed and will scrape off soot on the cooled surfaces. The scraper devices, however, cover the entire channel cross section, thus making it necessary to direct the flue gas on both sides of the devices.

SUMMARY OF THE INVENTION

The object of the present invention is to provide a heat exchanger which is either self-cleaning or without external cleaning equipment, thus enabling the heat exchanger to be cleaned during operation.

This object is achieved according to the invention with a heat exchanger with a central tube with scraper elements and which is characterized by the features presented in the patent claims.

In one embodiment the heat exchanger consists of two tube spools, one of which is permanently mounted on to the housing and the other mounted on to a movable central tube. By moving the two tube spools axially into contact with each other and thereafter screwing them along each other, they will scrape or rub the cooling surfaces clean of deposits. The movable tube spool is a part of the heat exchanger, thus eliminating the need for additional elements for removing deposits and this is one of the advantages of the invention.

In a further embodiment of the invention one of the helical tube spools which are mounted on to the central tube is replaced by scraper elements. These are preferably in the form of arms which are moved towards the permanently mounted tube spool and which scrape the cooled surfaces clean of deposits. The scraper arms can be designed substantially narrower than the channel, in such a manner that they do not obstruct the through-flow of the primary medium. In addition two surfaces of the scraper arms are always scraped clean of any deposits, thus ensuring that they do not increase in height, and this is a further advantage of the invention.

BRIEF DESCRIPTION OF THE DRAWINGS

The invention will now be described in connection with drawings which illustrate examples of embodiments of a heat exchanger, only the principles of the invention being illustrated.

DETAILED DESCRIPTION OF THE INVENTION

In the figures the same parts have the same reference numbers.

Figure 1:
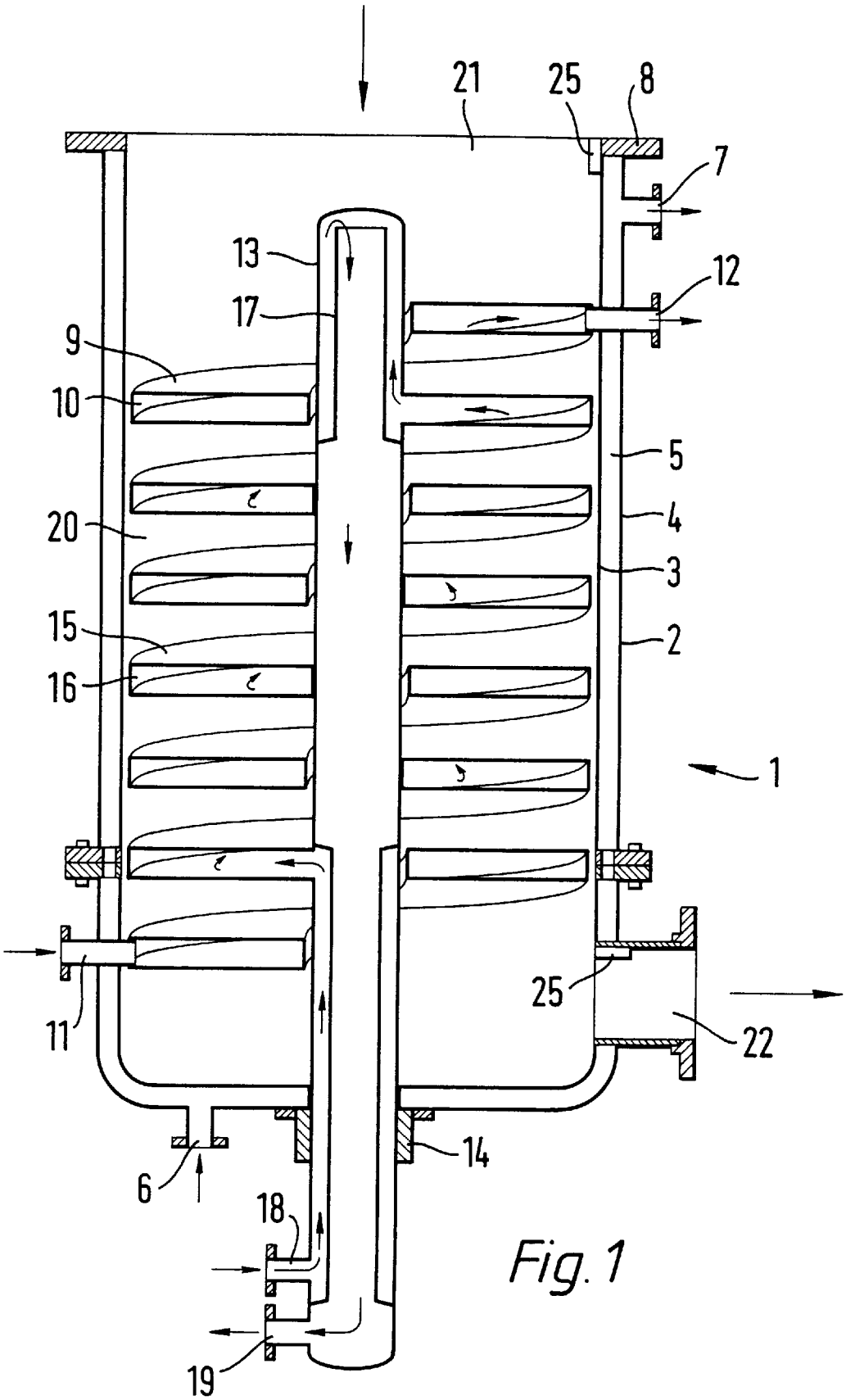
FIG. 1 is a longitudinal section through a heat exchanger with a permanently mounted helical insert and a helical insert mounted on to a movable central tube.

In FIG. 1 the heat exchanger is indicated by 1. It consists of a housing 2 which is constructed with an internal wall 3. The housing 2 can also be equipped with an external wall 4 so that a channel 5 is formed. The channel 5 has an inlet 6 and an outlet 7 for a medium. The secondary medium can be passed through the channel 5, the inner wall 3 of the housing 2, thus contributing to the heat exchange. The housing 2 can be designed with a flange 8, thus enabling it to be mounted on to the outlet opening for processing equipment, e.g. a reaction chamber.

A helical insert in the form of a tube spool 9 is mounted on to the internal wall 3. The tube spool 9 preferably has greater width, i.e. extension in the radial direction, than height, which is the extension in the axial direction. The tube spool 9 can have a rectangular, trapezoidal or triangular cross section. The distance between each winding in the tube spool 9 can be compared to a screw pitch and the number of windings can be chosen according to the requirements for heat transfer, etc.

The tube spool 9 is usually constructed of plates and the walls are the heat transfer surfaces. In some cases there is a need for high pressure in the secondary medium, e.g. in the production of steam by utilizing waste heat from a process. In this case the helical tube spool 9 can be composed of several tubes located beside one another, or the tube spool 9 can be reinforced by means of welded-on stays. The secondary medium is passed through the channel 10 in the tube spool 9 which is designed with an inlet 11 and an outlet 12.

The heat exchanger is designed with a central tube 13 located along the centre axis of the housing 2. The central tube 13 is axially movable and rotatable. The central tube 13 is passed through the housing 2 and the lead-through is sealed with a packing box 14 in the conventional manner.

On to the central tube 13 there is mounted a helical insert in the form of a tube spool 15 which has the same distance between the windings as the tube spool 9. The tube spool 15 can therefore be fed into the housing between the permanently mounted helical tube spool 9.

The secondary medium is passed through a channel 16 in the tube spool 15. The tube spool 15 can have a rectangular, trapezoidal or triangular cross section and may be composed of several tubes located beside one another. The central tube 13 is designed with an internal tube 17, thus forming channels which convey and distribute the secondary medium to and from the tube spool 15. The central tube 13 is designed with an inlet 18 and an outlet 19 for the secondary medium.

Both the tube spools 9 and 15 and the housing 2 contribute to the heat exchange, the secondary medium being passed through the channels 10 and 16 and through the channel 5 in the housing 2.

Between the tube spools 9 and 15 which are located at a certain distance from each other, there is formed a helical channel 20, and the primary medium is passed through this channel. By installing several parallel tube spools 9 and 15 the primary flow will be divided up into several parallel courses.

The primary medium passes from the inlet 21 through the helical channel 20 which is formed by the walls of the two tube spools 9 and 15, the inner wall 3 of the housing 2 and the central tube 13 and on to the outlet opening 22.

The width of the tube spools 9 and 15 is adapted in such a manner that it extends between the central tube 13 and the inner wall 3 of the housing 2 with a certain clearance.

The construction elements in the heat exchanger can be made of various materials depending on the operating temperatures of the primary and secondary media employed.

Moreover, the direction of flow of the primary medium and the secondary medium can be chosen according to the existing requirement for heat exchange and thereby parallel flow or counterflow heat exchange can be achieved in the known manner.

Figure 2:
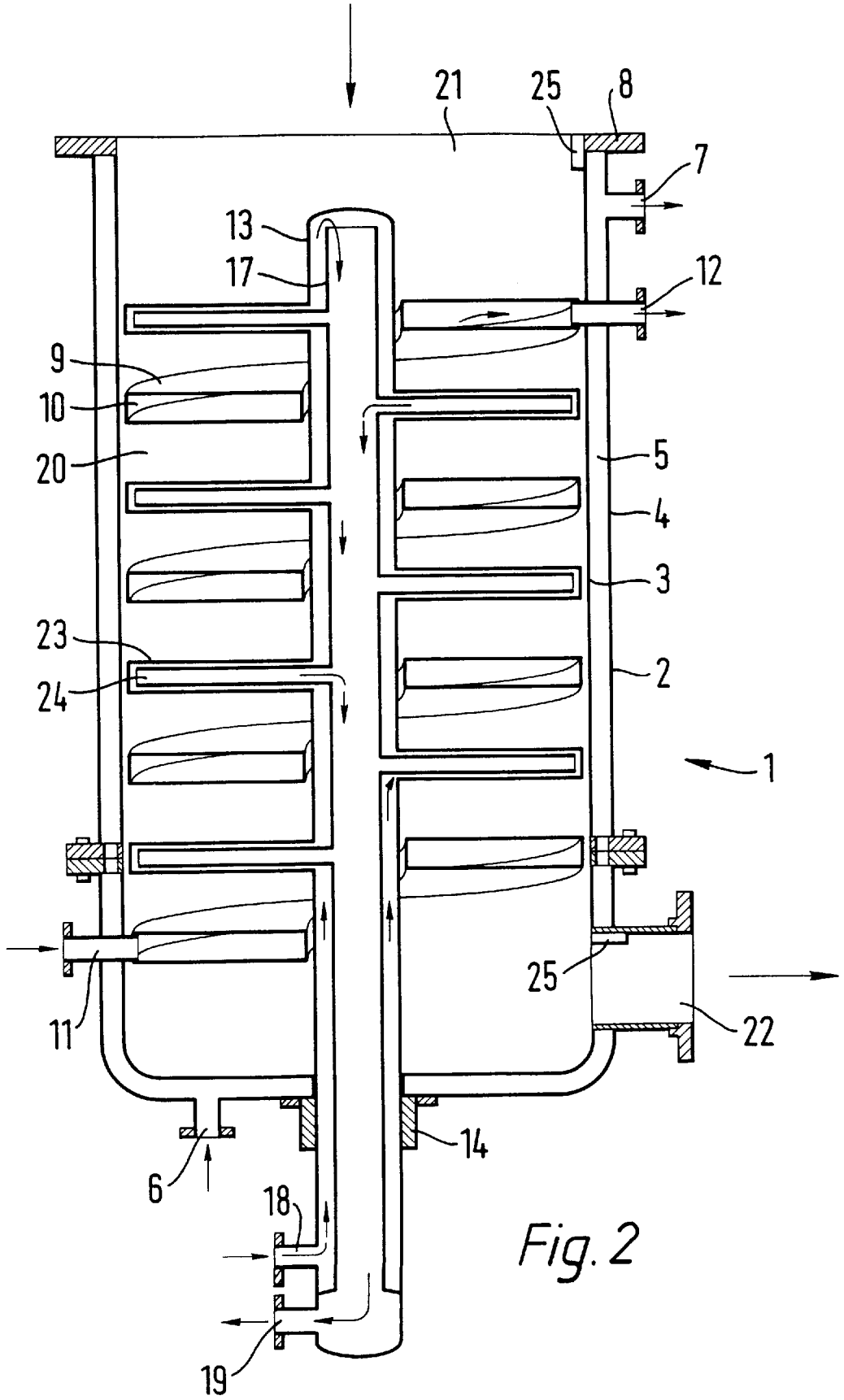
FIG. 2 is a longitudinal section through a heat exchanger with a permanently mounted helical insert and with scraper elements in the form of arms mounted on to the movable central tube.

FIG. 2 illustrates an embodiment wherein scraper arms are mounted on the central tube. In other respects the heat exchanger is designed as FIG. 1 and the same parts have the same reference numbers.

The heat exchanger is designed with a helical insert in the form of a tube spool 9. Between the windings in the tube spool 9 there is formed a helical channel 20 and the primary medium is passed through this channel from the inlet 21 to the outlet 22. The secondary medium is passed through the channel 10 from the inlet 11 to the outlet 12.

On to the central tube 13 which is axially movable and rotatable there are mounted scraper elements in the form of scraper arms. Two scraper arms 23 are preferably mounted per winding of the tube spool 9, and the scraper arms 23 are then located diametrically. The number of scraper arms 23 can be increased, thus correspondingly reducing the size of the required angle of rotation.

The scraper arms 23 are preferably designed in a cylindrical shape with greater length, i.e. extension in the radial direction, than diameter, which is extension in the axial direction. The length of the scraper arm is adapted in such a manner that it extends from the central tube 13 to the inner wall 3 of the housing 2 with a certain clearance. The scraper arm 23 will thereby clean the inner wall 3 of the housing 2. The scraper arms 23 are designed much narrower than the width of the channel 20, thus ensuring that the through-flow of the primary medium in the channel 20 is not obstructed. The number of scraper arms 23 in the channel 20 is also adapted to a minimum, thus ensuring that the through-flow of the primary medium is obstructed to the least possible extent.

If necessary the central tube 13 and the scraper arms 23 are cooled. In this case the scraper arms are equipped with an internal tube 24, thus forming channels for a cooling medium. The tubes 24 are mounted on to an internal tube 17 in the central tube 13. There are thereby formed in the central tube 13 channels which convey and distribute a cooling medium to the scraper arms 23. The cooling medium, which can be the secondary medium, is introduced through the inlet 18 and discharged through the outlet 19 in the central tube 13.

The apparatus works in the following way and an example of a cleaning cycle is described. Other cycles may be used. The heat transfer surfaces with deposits are cleaned by moving the central tube 13 with the tube spool 15 axially, e.g. in the direction towards the inlet 21, until the walls of the tube spool 15 are in contact with the walls of the tube spool 9 or at a defined distance from each other or until the deposits touch each other. The cooling surfaces are preferably moved close to each other but in such a manner that they do not come directly into contact with each other. This prevents wear on the surfaces, which in itself is a disadvantage. In addition it prevents materials which may be scraped off the heat transfer surfaces from polluting the primary medium.

The central tube 13 is then rotated a half turn, e.g. in a clockwise direction, while at the same time the walls of the tube spools 9 and 15 are kept at the same distance from each other. The movable tube spool 15 is thereby screwed along the permanent tube spool 9 and deposits are scraped or rubbed off the wall surfaces in the entire channel opening.

The next stage in the cleaning process consists in the central tube 13 being moved axially in the direction towards the packing box 14 until the walls of the tube spools 9, 15 are in contact with each other. The central tube 13 is then rotated a half turn in an anticlockwise direction, thus causing deposits to be scraped or rubbed off the surfaces.

Finally the central tube 13 is moved in such a manner that the tube spool 15 is placed in a neutral position.

In order to cover both sides of the ends of both inserts by causing the inserts to be rubbed against each other, they have to rotate at least one turn in relation to each other. At a point where the surfaces cover each other, the rubbing movement, i.e. where the surfaces are screwed along each other and touch each other, may be short in order for the deposits to break off. If desirable the rotational movement can be reduced, but this will cause the cleaning effect to be reduced on a part of the end surfaces of the insert.

The cleaning cycle can be performed with the same steps when scraper arms 23 are mounted on the central tube 13. It may, however, be necessary to rotate the central tube 13 one or more turns each way depending on the number of scraper arms 23 mounted on the central tube 13.

By means of a cleaning cycle of this kind all cooled surfaces are scraped in the channel 20, both walls of the tube spools 9 and 15, the inner wall 3 of the housing 2 and the outer surface of the central tube 13. This is one of the advantages of the invention.

In addition the tube spool 15 or a scraper arm 23 will clean the cylindrical inner wall 3 for some distance above the entrance to the helical channel 20. The length of the cleaned surface can be selected by means of the design of the central tube 13 and the axial movement thereof. A scraper arm 23 may be mounted outside the tube spool 9.

At the outlet of a reactor, boiler or the like there normally occurs some narrowing of the flow cross section which in turn can cause a large concentration of particles or deposits. By placing the heat exchanger under a reaction chamber or boiler room the tube spool 15 or one or more scraper arms 23 will have a lifting and rotating movement, thus causing loose materials above the heat exchanger to fall down and follow the product stream out of the system.

The cross section of the channel 20 is selected in order that the flow velocity of the primary medium will be sufficient to enable the deposits which have been scraped loose to follow the flow out of the heat exchanger. Moreover, by making the correct choice of scraping direction in relation to the force of gravity, the scraper arms 23 can help to feed by stages deposits which have been scraped loose out of the heat exchanger.

Figure 3A:
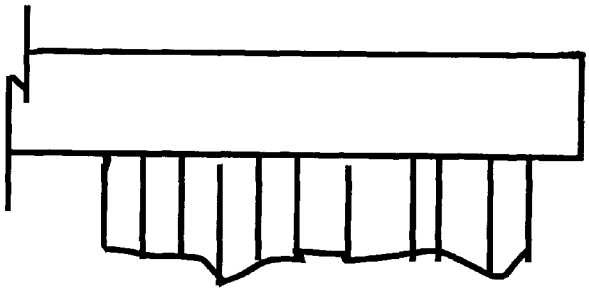
FIGS. 3A, 3B and 3C show alternate embodiments of the scraper device.
Figure 3B:
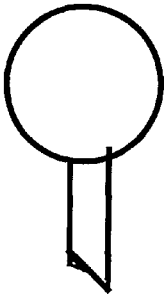
Figure 3C:
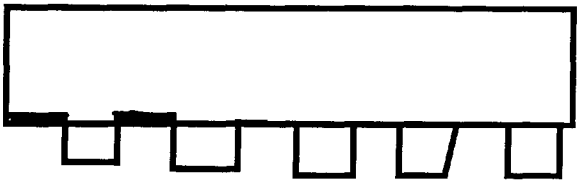

The heat transfer surfaces in a heat exchanger preferably have a smooth surface. As shown in FIGS. 3A, 3B and 3C, in order to increase the cleaning effect one surface or both the surfaces which come into contact with each other during the cleaning stages can be equipped with brushes 24', a rough or grainy surface, grooves or ridges 24''' with a certain pattern or with knives, scraping edges 24'' or cutting edges. This is not illustrated in the drawings.

In one embodiment the surface can have an uneven shape, e.g. a corrugated shape. The deposits will then be exposed to varying loads when the surfaces are rubbed against each other and will be more easily broken up.

In a further embodiment the surface can be equipped with grooves such as ridges with a kind of pattern in which the grooves, e.g., are slanting in relation to the radial direction. When the surfaces rotate in relation to each other the deposits will move sideways and be pushed out of the pattern.

The central tube 13 can be connected to a device which may be motor-driven, e.g. hydraulically operated, the central tube thus performing the axial to and fro movements and the rotational movements which are necessary for a cleaning cycle.

A cleaning cycle can run continuously or intermittently and the cleaning rate can be controlled, e.g., by the temperature difference between inlet and outlet for one of the media or by the outlet temperature for one of the media when the inlet temperature and the flow rate are constant.

Temperature sensors 25, e.g. thermoelements, can be placed both at the inlet opening 21 and the outlet opening 22. A drop in the temperature difference for the primary medium between the two measurement points will indicate that the heat transfer is being reduced due to the formation of deposits and this can start a cleaning cycle or increase the rate thereof.

With a heat exchanger according to the invention the cleaning can be performed during operation. It is not necessary to stop a process either in order to wash a heat exchanger or in order to dismantle it for cleaning.

It is claimed:

1. A heat exchanger comprising a housing having a central axis and a permanently mounted helical insert which forms a channel for one heat exchange medium, said insert including at least one channel for a second heat exchange medium, a central tube placed along the central axis of said housing and including a scraper device, said central tube and said scraper device being axially movable and rotatable in and relative to said housing, said scraper device comprising a helical insert of the same type as said permanently mounted helical insert and includes a channel provided therein in flow connection with the second heat exchange medium via said central tube.

2. A heat exchanger according to claim 1, characterized in that there are provided a plurality of scraper arms symmetrically around the central tube in each winding in the permanently mounted helical insert.

3. A heat exchanger as claimed in claim 1 wherein said scraper device has at least one surface permanently mounted in said housing with said surface provided with scraping members.

4. A heat exchanger as claimed in claim 3 wherein said scraping members include brushes.

5. A heat exchanger as claimed in claim 3 wherein said scraping members include cutting edges attached to said surfaces.

6. A heat exchanger as claimed in claim 3 wherein said scraping members include grooves on said surfaces.

7. A heat exchanger comprising a housing having a central axis and a permanently mounted helical insert which forms a channel for one heat exchange medium, said insert including at least one channel for a second heat exchange medium, a central tube placed along the central axis of said housing and including a scraper device, said central tube and said scraper device being axially movable and rotatable in and relative to said housing, said scraper device including at least one scraper arm which is tubular in shape having a greater length than diameter, said scraper arm forming a channel in flow communication with the second heat exchange medium.

* * * * *